US009581406B1

(12) United States Patent
Nevels et al.

(10) Patent No.: US 9,581,406 B1
(45) Date of Patent: Feb. 28, 2017

(54) WEDGE LOCK LIMB POCKET

(71) Applicant: Precision Shooting Equipment, Inc., Tucson, AZ (US)

(72) Inventors: Samuel S. Nevels, Marana, AZ (US); Allen C. Rasor, Jr., Marana, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 15/299,938

(22) Filed: Oct. 21, 2016

Related U.S. Application Data

(60) Provisional application No. 62/244,324, filed on Oct. 21, 2015.

(51) Int. Cl.
*F41B 5/10* (2006.01)
*F41B 5/14* (2006.01)
*F41B 5/00* (2006.01)

(52) U.S. Cl.
CPC ..... *F41B 5/10* (2013.01); *F41B 5/0026* (2013.01); *F41B 5/14* (2013.01); *F41B 5/1403* (2013.01)

(58) Field of Classification Search
CPC .. F41B 5/0026; F41B 5/10; F41B 5/14; F41B 5/1403
USPC ..... 124/23.1, 25, 25.6, 86, 88
See application file for complete search history.

(56) References Cited

U.S. PATENT DOCUMENTS 3,486,495 A * 12/1969 Holless ..... F41B 5/10 124/25.6
4,574,766 A * 3/1986 Izuta ..... F41B 5/0026 124/23.1
4,644,929 A * 2/1987 Peck ..... F41B 5/10 124/23.1
5,231,970 A * 8/1993 Ploot ..... F41B 5/10 124/23.1
5,280,779 A * 1/1994 Smith ..... F41B 5/0026 124/23.1
5,339,790 A * 8/1994 Smith ..... F41B 5/10 124/23.1
5,429,106 A * 7/1995 Martin ..... F41B 5/0026 124/23.1
5,487,373 A * 1/1996 Smith ..... F41B 5/10 124/23.1
5,515,836 A * 5/1996 Martin ..... F41B 5/0026 124/23.1

(Continued)

OTHER PUBLICATIONS

Excerpts from You Tube video uploaded/published on Oct. 28, 2013, entitled "2014 PSE CenterLock™ 2 Limb Pockets", accessible at the Internet domain address https://www.youtube.com/watch?v=oSugk2HwSbk.

*Primary Examiner* — Alexander Niconovich
(74) *Attorney, Agent, or Firm* — Cahill Glazer PLC

(57) ABSTRACT

A limb mounting pocket receives butt ends of split limbs of an archery bow. The pocket includes a top wall extending above the butt ends. First and second outer side walls extend from opposite sides of the top wall for engaging outer sides of the butt ends. First and second tabs each have a first end coupled to the lower face of the top wall and having an opposing free end for engaging the inner side walls of the butt ends. An actuating member, which may be a tapered wedge, is disposed between the free ends of the first and second tabs for pushing the first and second tabs generally away from each other and against the inner sides of the butt ends of the limbs to minimize lateral movement thereof.

9 Claims, 5 Drawing Sheets

(56) References Cited

U.S. PATENT DOCUMENTS 5,720,267 A * 2/1998 Walk ..... F41B 5/10 124/23.1
6,024,076 A * 2/2000 Laborde ..... F41B 5/0026 124/23.1
6,360,734 B1 * 3/2002 Andrews ..... F41B 5/10 124/23.1
6,543,432 B2 * 4/2003 Andrews ..... F41B 5/10 124/23.1
6,684,870 B1 * 2/2004 Land ..... F41B 5/10 124/23.1
6,886,549 B2 * 5/2005 McPherson ..... F41B 5/0026 124/23.1
7,334,575 B2 * 2/2008 McPherson ..... F41B 5/0026 124/23.1
7,584,750 B2 * 9/2009 Chang ..... F41B 5/12 124/23.1
7,784,452 B1 * 8/2010 Kronengold ..... F41B 5/10 124/23.1
8,047,189 B2 * 11/2011 McPherson ..... F41B 5/10 124/23.1
8,069,847 B2 * 12/2011 Blosser ..... F41B 5/0026 124/23.1
8,281,773 B2 * 10/2012 Dahl, II ..... F41B 5/10 124/23.1
8,347,869 B2 * 1/2013 Sims ..... F41B 5/10 124/23.1
8,408,192 B2 * 4/2013 McPherson ..... F41B 5/10 124/23.1
8,453,635 B1 * 6/2013 McPherson ..... F41B 5/10 124/23.1
8,701,644 B2 * 4/2014 McPherson ..... F41B 5/10 124/23.1
8,776,770 B2 * 7/2014 Batdorf ..... F41B 5/10 124/23.1
8,844,508 B2 * 9/2014 Sims ..... F41B 5/10 124/25
9,103,622 B2 * 8/2015 Park ..... F41B 5/0026
9,285,180 B2 * 3/2016 McPherson ..... F41B 5/10
9,366,497 B1 * 6/2016 Hout ..... F41B 5/0026
9,389,039 B2 * 7/2016 Denton ..... F41B 5/0052
2015/0226511 A1 * 8/2015 Chang ..... F41B 5/1426 124/23.1

* cited by examiner

FIG. 1
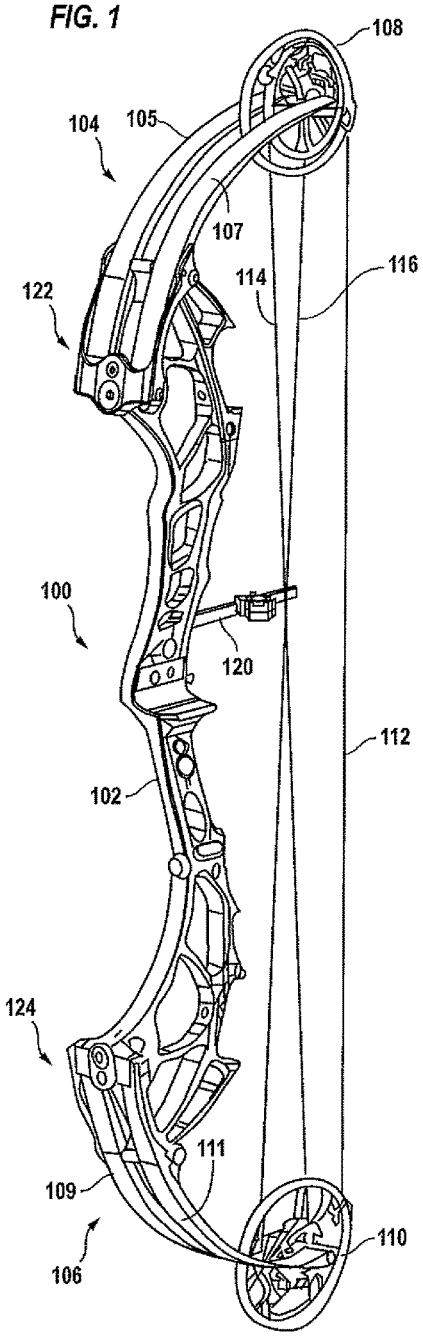
FIG. 2
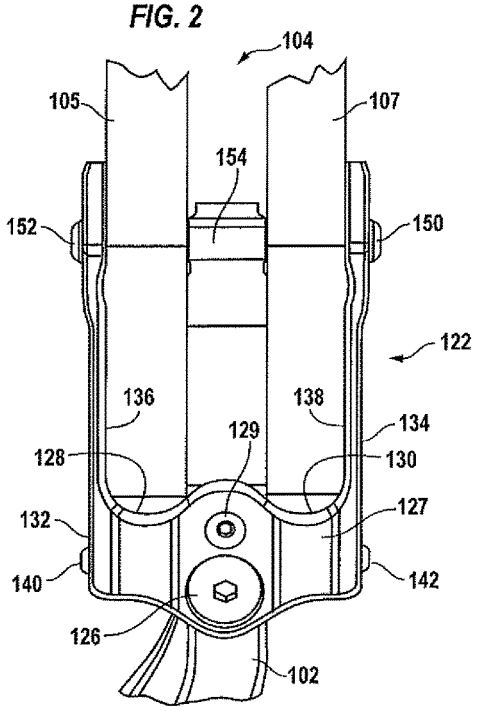
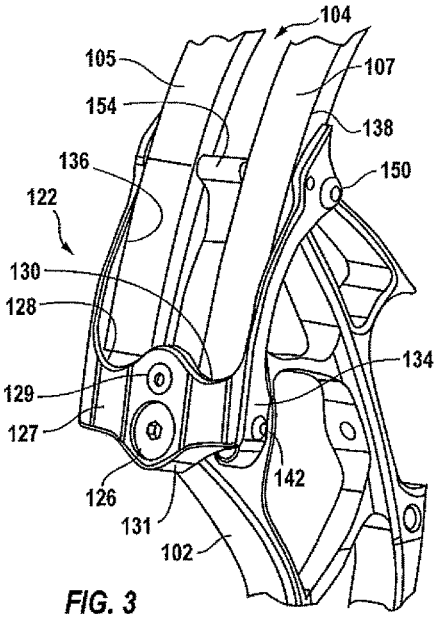
FIG. 3

WEDGE LOCK LIMB POCKET

CROSS-REFERENCE TO RELATED PATENT APPLICATIONS

This non-provisional patent application claims the benefit of prior-filed U.S. provisional patent application No. 62/244,324, filed on Oct. 21, 2015, under 35 U.S.C. 119(e).

FIELD OF THE INVENTION

The present invention relates generally to compound archery bows and crossbows, and more particularly, to apparatus for minimizing lateral movement of the butt ends of split bow limbs within a limb pocket of the bow.

BACKGROUND OF THE INVENTION

Compound archery bows are well known in the field of archery. An early example of a compound archery bow is shown in U.S. Pat. No. 3,486,495 to Allen. A handle, or riser, supports upper and lower oppositely directed limbs. A pair of pulleys, or cams, are rotatably supported at the tips of the opposing limbs, and a bowstring extends between the two cams for driving an arrow. One or more cables also extend between the two cams to control the force required to pull the bowstring back as it is drawn from a rest position to a fully-drawn position.

The earliest compound bows typically used so-called solid limbs. For example, in the aforementioned U.S. Pat. No. 3,486,495 to Allen, each of the upper and lower limbs of the bow is a solid piece of material (wood, fiberglass, etc.) that is bifurcated at its distal tip end for allowing a pulley or cam to be positioned between the bifurcated ends of the distal tip end and pivotally mounted upon an axle supported by such bifurcated ends. More recently, compound bows have been provided with so-called split limb configurations wherein the former solid, relatively-wide upper limb is replaced by a pair of narrower, spaced "split" limb members. Examples of such split-limb compound bows are shown and described in U.S. Pat. No. 4,644,929 to Peck, and U.S. Pat. No. 5,720,267 to Walk.

The use of split limbs provides several advantages, including less weight and often faster arrow speed. On the other hand, the use of split limbs can complicate the secure coupling of the butt ends of the split limbs to the bow riser. As noted in the aforementioned U.S. Pat. No. 5,720,267 to Walk, the butt ends (innermost ends) of the split limbs are typically mounted to the bow riser by limb mounting pockets. As further noted by Walk, it is important to properly constrain the butt ends of the split limbs within the limb mounting pocket; in this regard, Walk describes a limb mounting pocket having a bottom member and a top member that is secured to the bottom member by a threaded bolt, in one embodiment, or as integral structure, in another embodiment, for enclosing the butt ends of the split limbs. Both the bottom member and top member have central dividers to form two channels in which the butt ends of the split limbs are held. However, Walk does not apply any lateral force against the sides of the split limbs within the limb mounting pockets.

The assignee of the present invention has found that manufacturing tolerances of the limb and limb mounting pockets tend to allow small spaces, or gaps, that allow the butt ends of the split limbs to move and shift laterally within the limb mounting pocket. Such lateral shifting can create limb alignment and bow tuning problems as the limbs, and the cams mounted at the ends of such limbs, move laterally over time. While those skilled in the art have attempted to provide limb mounting pockets that reliably lock the butt ends of the split limbs within the pocket in a manner that prohibits lateral movement of the limbs, such attempts have not provided a simple, inexpensive, and easily-manufactured limb lock for a limb mounting pocket.

Accordingly, it is an object of the present invention to provide a limb mounting pocket for a compound archery bow that reliably and securely maintains the butt ends of split limbs within the pocket in a manner that prevents lateral shifting of the limbs within the pocket.

Another object of the present invention is to provide such a limb mounting pocket that reduces the need to maintain strict manufacturing tolerances on the dimensions of the limb mounting pocket, and the split limbs, in order to prevent lateral shifting of the limbs within the limb mounting pocket.

Still another object of the present invention is to provide such a limb mounting pocket that can easily be accessed and operated after bow assembly to remove any lateral gaps or spaces between the sides of the bow limbs and the walls of the limb mounting pocket.

Yet another object of the present invention is to provide such a limb mounting pocket that simultaneously forces both of the split limbs against the outward walls of the limb mounting pocket with a single, rapid adjustment.

A further object of the present invention is to provide such a limb mounting pocket that is easy and inexpensive to manufacture.

These and other objects of the invention will become more apparent to those skilled in the art as the description of the present invention proceeds.

SUMMARY OF THE INVENTION

Briefly described, and in accordance with a preferred embodiment thereof, the present invention relates to a limb mounting pocket for receiving butt ends of split limbs of a compound archery bow, the limb mounting pocket including engagement surfaces for engaging the inner side walls of the split limbs, and including a member for selectively pushing the engagement surfaces outwardly away from each other to prevent any lateral movement of the butt ends of the split limbs within the pocket. In the preferred embodiment, cams or pulleys are supported at the opposite ends, or limb tips, of the split limbs.

The limb mounting pocket includes a top wall disposed above (i.e., in front of) the butt ends of the split limbs. The pocket further includes opposing first and second outer side walls coupled to opposing sides of the top wall of the limb mounting pocket and extending generally perpendicular thereto; the first outer side wall is adapted to engage the outer side wall of the butt end of a first split limb, and the second outer side wall is adapted to engage the outer side wall of the butt end of a second split limb.

First and second spaced tabs are disposed below the underside (or lower face) of the top wall, i.e., behind the top wall. Each of the first and second spaced tabs has a first end coupled to the lower face of the top wall and having an opposing free end. In the preferred embodiment, the first ends of the first and second tabs are fixedly attached to the lower face of the top wall, while the opposing free ends can move laterally.

The first and second tabs each extend generally perpendicular to the top wall for engaging the inner side walls of the butt ends of the split limbs. The butt end of a first split limb is disposed between the first outer side wall and the first tab of the pocket. Likewise, the butt end of a second split limb is disposed between the second outer side wall and the second tab of the pocket.

The first and second tabs each have inner faces that are directed toward each other, and outer faces that are directed away from each other. The outer faces of the first and second tabs provide first and second engagement surfaces that may be used to force the split limbs away from each other toward the respective outer side walls of the pocket. The pocket further includes an actuating member disposed generally between the first and second tabs to push them outwardly apart from each other.

In a preferred embodiment, this actuating member is in the form of a tapered wedge having first and second opposing tapered surfaces for engaging the first and second tabs, respectively; the tapered wedge is selectively advanced into the gap between the first and second tabs to push them apart. Preferably, the tapered wedge has a threaded bore formed therein. An adjustment screw, accessible from above the top wall of the pocket, and having a shaft extending within a through-hole formed in the top wall of the pocket, is threadedly engaged with the threaded bore of the tapered wedge. As the adjustment screw is tightened, the tapered wedge progresses further into the gap lying between the first and second tabs, forcing the free ends of the first and second tabs further apart from each other; in turn, the first and second tabs engage the inner side walls of the split limbs and simultaneously force them against the outer side walls of the pocket, thereby eliminating any lateral spacing and/or lateral movement between the butt ends of the split limbs and the pocket.

In the preferred embodiment, the inner faces of the first and second tabs are themselves tapered to be somewhat thicker proximate to the underside of the top wall, and somewhat thinner at their opposing free ends. Preferably, the taper on the inner faces of the first and second tabs generally conforms to the taper formed on the opposing sides of the tapered wedge to ensure that the opposing tapered surfaces of the wedge make reliable contact, over a wider contact area, with the inner faces of the tabs.

In the preferred embodiment, a hole is provided in the top wall of the limb mounting pocket for receiving the head of a limb bolt; the limb bolt threadedly engages the bow riser for adjusting the angular orientation of the limb mounting pocket relative to the bow riser. The wedge adjustment screw may be conveniently located adjacent to the bore formed in the top wall of the limb pocket that receives the limb bolt used to adjust the angular orientation of the pocket relative to the riser. Also, in the preferred embodiment, each of the first and second outer side walls includes a hole for receiving a pivot shaft for pivotally supporting the limb mounting pocket to an end of the bow riser.

BRIEF DESCRIPTION OF THE DRAWINGS

FIG. 1 is a perspective view of a compound archery bow incorporating the improved wedge lock limb pocket in accordance with a preferred embodiment of the present invention.

FIG. 2 is a front view of the wedge lock limb pocket and portions of the split limbs and riser to which it is coupled.

FIG. 3 is a front perspective view of the wedge lock limb pocket shown in FIG. 2.

DETAILED DESCRIPTION OF THE PREFERRED EMBODIMENT

Figure 4:
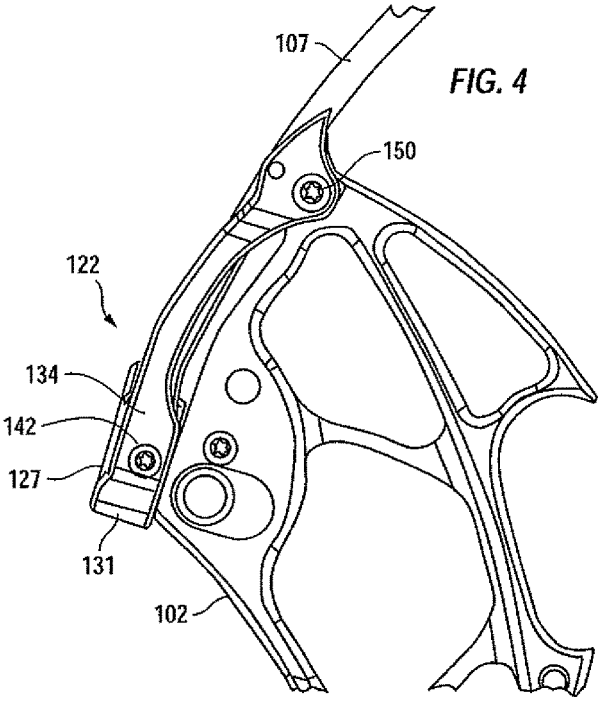
FIG. 4 is a side view of the wedge lock limb pocket shown in FIG. 2.

Within FIG. 1, compound archery bow 100 includes a riser 102 and upper and lower bow limb assemblies 104 and 106, respectively. Upper limb 104 assembly includes a first pair of split limbs 105 and 107 which extend upwardly from riser 102 to their upper limb tips to which a cam or pulley 108 is rotatably coupled. Likewise, lower limb assembly 106 includes a second pair of split limbs 109 and 111 which extend downwardly from riser 102 to their lower limb tips to which a cam or pulley 110 is rotatably coupled. Bowstring 112 extends between cams 108 and 110, and may be drawn by a user to drive an arrow. A power cable 114 and a synchronization cable 116 also extend between cams 108 and 110 in a manner known to those skilled in the art. A flexible cable guard 120 engages cables 114 and 116 to displace such cables out of the plane of the bowstring, and away from the path of a released arrow, as the rear end of the arrow passes riser 102. An upper limb mounting pocket 122 secures the butt ends of split limbs 105 and 107 to the upper end of riser 102; similarly, a lower limb mounting pocket 124 secures the butt ends of split limbs 109 and 111 to the lower end of riser 102.

As shown in FIGS. 2 and 3, upper limb mounting pocket 122 is adjustably secured to the upper end of riser 102 by a conventional limb bolt 126. As is well known in the art, limb bolt 126 may be tightened or loosened to adjust the angle at which limb assembly 104 is directed, thereby adjusting the draw weight, brace height, and/or other characteristics of compound bow 100. Limb pocket 122 includes a top wall 127 that extends above the lowermost butt ends 128 and 130 of split limbs 105 and 107, respectively. The recessed head of limb bolt 126 is accessible from just above top wall 127 of limb pocket 122; the shaft of limb bolt 126 extends through a hole formed in top wall 127 and engages a threaded mounting hole in the upper end of riser 102. Also visible in FIGS. 2 and 3 is a wedge lock adjustment screw 129, the purpose of which will be described below.

Limb pocket 122 also includes opposing first and second outer side walls 132 and 134 that extend downward generally perpendicular to top wall 127. The outer side face 136 of split limb 105 is engaged by, and supported by outer side wall 132 of limb pocket 122. Likewise, the outer side face 138 of split limb 107 is engaged by, and supported by outer side wall 134 of limb pocket 122. Also partially visible within FIG. 3 is a front wall 131; front wall 131 extends downwardly from the front of top wall 127 generally perpendicular thereto. Front wall 131 is also joined with the front portions of side walls 132 and 134. In the preferred embodiment, top wall 127, front wall 131, and side walls 132 and 134 are all integrally formed from a single piece of lightweight metal, such as aluminum.

Figure 9:
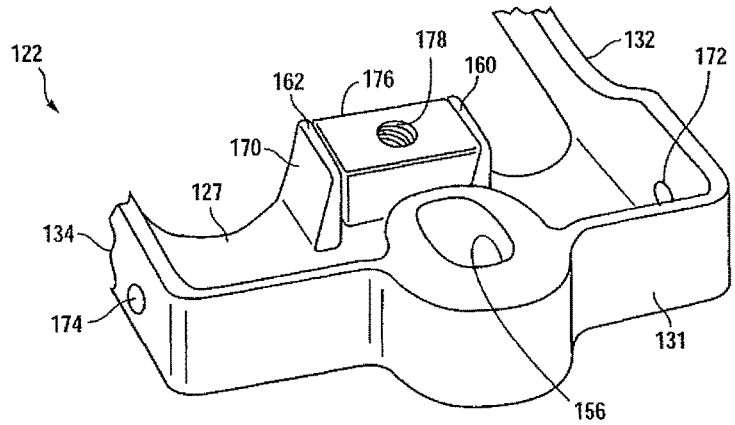
FIG. 9 is a partial perspective view of the wedge lock limb pocket shown in FIGS. 7 and 8 after a locking wedge has been secured thereto.

To prevent the butt ends 128 and 130 of split limbs 105 and 107 from inadvertently pulling loose from limb pocket 122 during assembly or adjustment of the bow, a pair of screws 140 and 142 are provided. Screw 140 is inserted through a tapped hole formed in limb pocket side wall 132 for extending into a lateral hole formed in butt end 128 of split limb 105. Similarly, screw 142 is inserted through a tapped hole formed in limb pocket side wall 134 for extending into a lateral hole formed in butt end 130 of split limb 107. Screws 140 and 142 help insure that split limbs 105 and 107 do not slip out of limb pocket 122, but these screws do not constrain lateral movement of butt ends 128 and 130 within limb pocket 122. Referring briefly to FIG. 9, tapped holes 172 and 174 are formed near the front ends of side walls 132 and 134, respectively, of limb pocket 122 for threadedly receiving screws 140 and 142.

Figure 5:
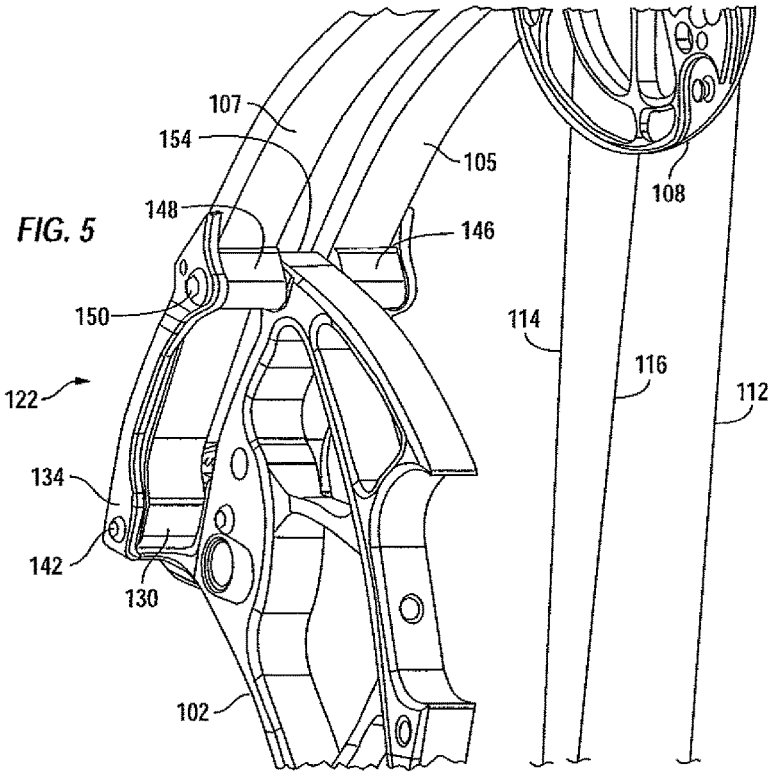
FIG. 5 is a rear perspective view of the wedge lock limb pocket shown in FIG. 2.
Figure 6:
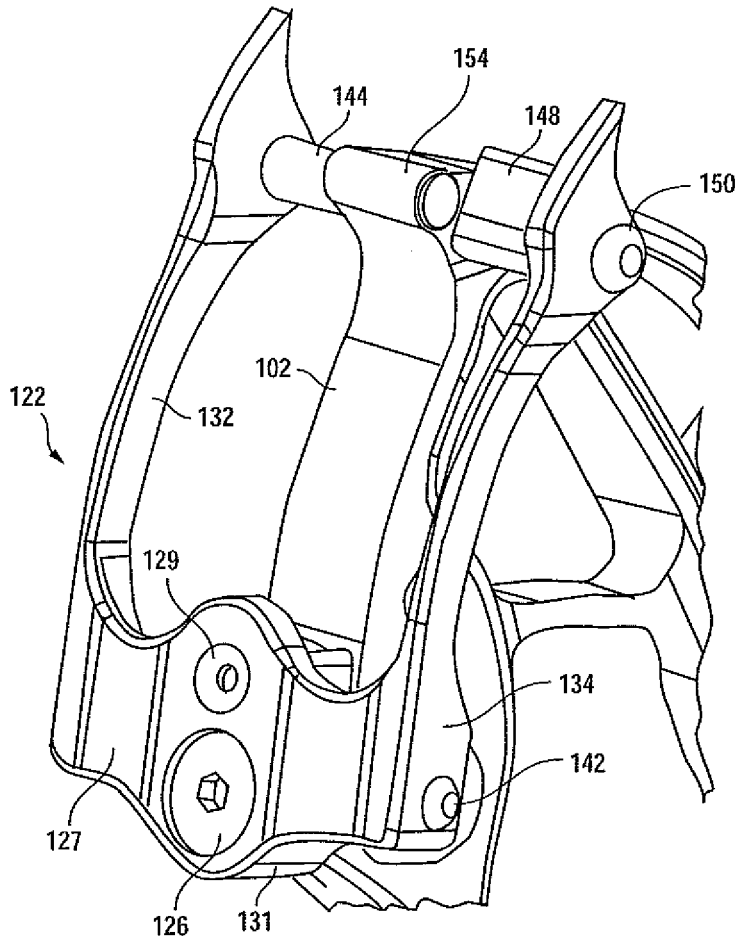
FIG. 6 is a partial perspective view of the wedge lock limb pocket shown in FIG. 2, but wherein the split limbs, and one of the limb supports, have been omitted to reveal a pivot shaft.

Referring now to FIGS. 4-6, limb pocket 122 is also supported upon riser 102 by a pivot shaft 144 disposed proximate to the uppermost portion of limb pocket 122. Pivot shaft 144 is not usually visible; referring to FIG. 5, pivot shaft 144 is hidden by screw 150, limb support 148, riser 102, and limb support 146. Within FIG. 6, however, split limbs 105 and 107, and limb support 146, have been omitted for clarity in order to better show the location of pivot shaft 144. Pivot shaft 144 extends entirely across limb pocket 122 between side walls 132 and 134; the opposing ends of pivot shaft 144 are seated within corresponding holes formed in side walls 132 and 134 and secured therein by screws 150 and 152 (see FIG. 2). Pivot shaft 144 passes through a corresponding hole in riser 102 and can rotate therein as limb screw 126 is adjusted to vary the angular orientation of limb pocket 122. Pivot shaft 144 also passes through corresponding bores formed in limb supports 146 and 148, which serve as the fulcrums over which split limbs 105 and 107 are bent, respectively. Those skilled in the art will note that riser 102 terminates in a projecting spacer 154 that extends between split limbs 105 and 107, and serves to prevent split limbs 105 and 107 from becoming laterally shifted toward each other at the upper end of limb pocket 122.

Figure 7:
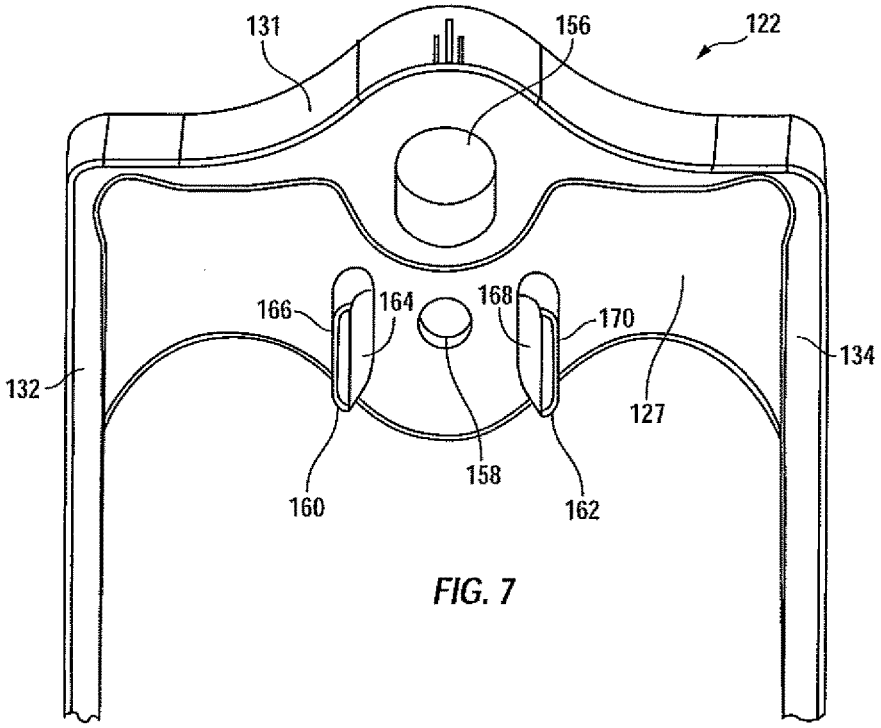
FIG. 7 is a perspective view of the underside of the wedge lock limb pocket before the split limbs and locking wedge are assembled therein, as viewed from a first angle.
Figure 8:
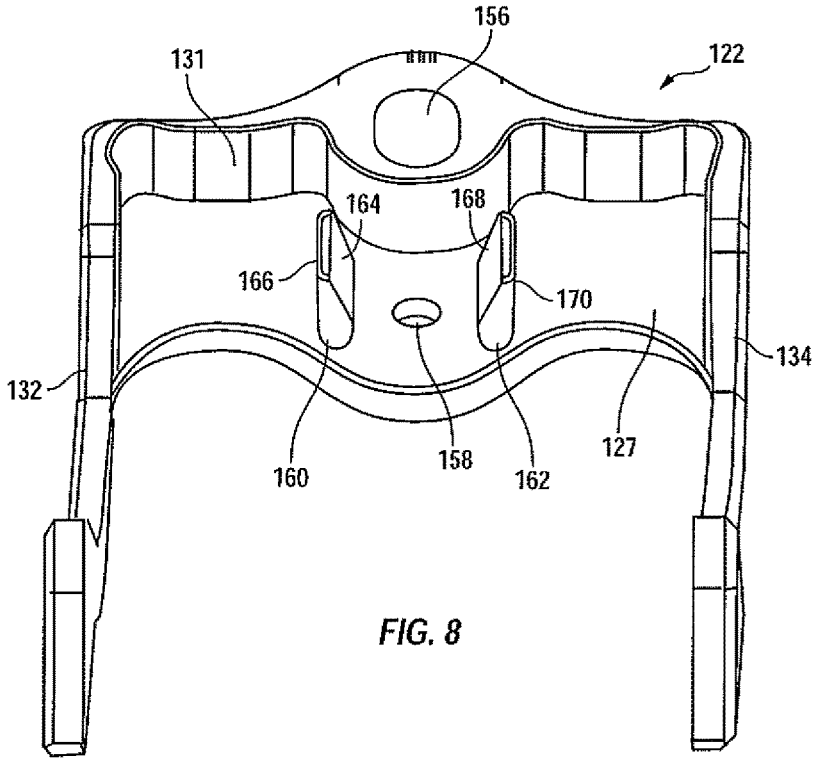
FIG. 8 is a perspective view of the underside of the wedge lock limb pocket before the split limbs and locking wedge are assembled therein, as viewed from a second angle.

FIGS. 7 and 8 show the underside of the wedge lock limb pocket 122. Bore 156 is formed within a thickened, reinforced portion of front wall 131, and extends entirely through top wall 127, for receiving limb bolt 126 (see FIGS. 2 and 3). First and second spaced tabs 160 and 162 each extend downwardly from the underside of top wall 127; preferably, tabs 160 and 162 are formed integrally with top wall 127 of the same lightweight metal. A smaller bore 158 is formed in top wall 127, and extends along an axis centered between tabs 160 and 162, for receiving wedge lock adjustment screw 129 mentioned above in regard to FIGS. 2 and 3.

Tab 160 has an inner face 164 and an outer face 166. Likewise, tab 162 has an inner face 168 and an outer face 170. The inner faces 164 and 168 of tabs 160 and 162 are generally directed towards each other, while the outer faces 166 and 170 of tabs 160 and 162 are directed away from each other. In the preferred embodiment, tabs 160 and 162 are tapered to be somewhat thicker proximate to the underside of top wall 127, and somewhat thinner at their opposing free ends; in this regard, inner faces 164 and 168 of tabs 160 and 162 are preferably offset at a small angle from a plane extending perpendicular to top wall 127, whereby inner faces 160 and 162 diverge from each other slightly as they extend further away from top wall 127 toward their free ends. Outer faces 166 and 170 are initially essentially parallel to each other and parallel to side walls 132 and 134 of limb pocket 122. Tabs 160 and 162 are capable of flexing under sufficient force.

Figure 10:
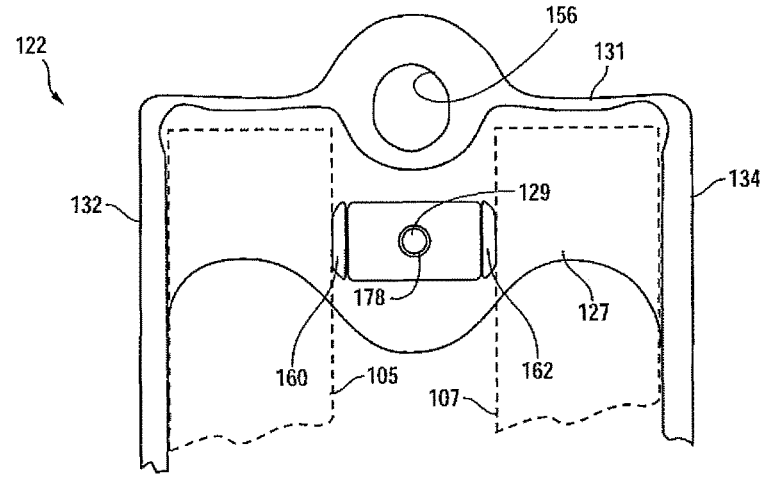
FIG. 10 is a bottom view of the wedge lock limb pocket shown in FIG. 9, wherein the location of the butt ends of two split limbs are indicated in dashed outline.
Figure 11:
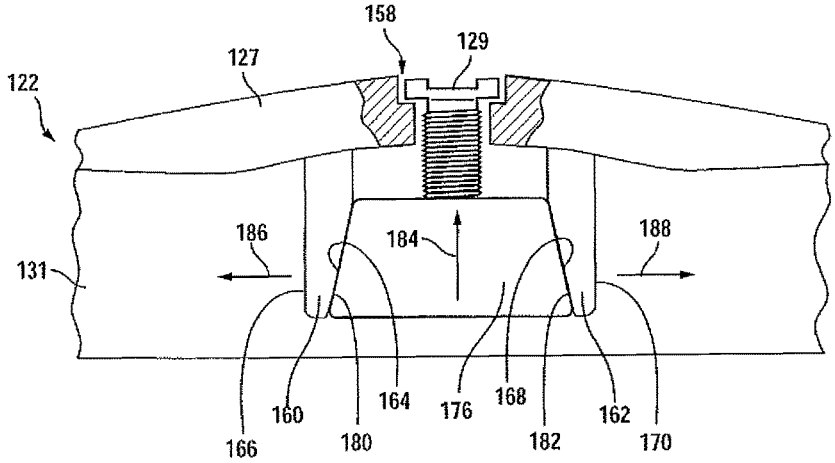
FIG. 11 is a partially cut-away rear view of the wedge lock limb pocket shown in FIGS. 9 and 10 and illustrating the manner by which an adjustment screw advances the locking wedge to push the butt ends of the split limbs outwardly against the outer walls of the limb pocket.

Turning now to FIGS. 9-11, an actuating wedge 176 is shown inserted between tabs 160 and 162. A threaded bore 178 is formed in wedge 176 to receive the lower end of the shaft of wedge lock adjustment screw 129; the upper end of the shaft of wedge lock adjustment screw 129 extends through bore 158 of top wall 127, as shown in FIG. 11. Screw 129 and wedge 176 serve as an actuating member to push tabs 160 and 162 outwardly apart from each other. As shown in FIG. 11, wedge 176 preferably includes tapered side walls 180 and 182. The angle of taper for side walls 180 and 182 is preferably the same as the angle of taper for inner faces 164 and 168 of tabs 160 and 162, respectively; this helps to insure that tapered walls 180 and 182 of wedge 176 make more reliable contact, over a wider contact area, with inner faces 164 and 168 of tabs 160 and 162. As screw 129 is tightened, wedge 176 is pulled toward top wall 127, as indicated by arrow 184 in FIG. 11, which, in turn, forces tabs 160 and 162 outwardly, as indicated by arrows 186 and 188. As indicated in FIGS. 2, 3 and 6, the head of wedge lock adjustment screw 129 is accessible from above top wall 127 of limb pocket 122, adjacent to limb bolt 126, making it easy for the owner of the bow to periodically tighten wedge lock adjustment screw 129, as needed.

Within FIG. 10, the butt ends of split limbs 105 and 107 are shown in dashed outline. The butt end of split limb 105 rests against top wall 127, side wall 132, and outer face 166 of tab 160. Likewise, split limb 107 rests against top wall 127, side wall 134, and outer face 170 of tab 162. As wedge lock adjustment screw 129 is tightened, tabs 160 and 162 are forced outwardly. Outer face 166 of tab 160 provides an engagement surface for engaging the inner side face of split limb 105 and pushes split limb 105 against outer wall 132 of limb pocket 122. Similarly, outer face 170 of tab 162 provides an engagement surface for engaging the inner side face of split limb 107 and pushes split limb 107 against outer wall 134 of limb pocket 122. Thus, wedge 176 simultaneously forces split limbs 105 and 107 against outer side walls 132 and 134 of limb pocket 122, thereby eliminating any lateral spacing between split limbs 105 and 107 and limb pocket 122, and avoiding any resulting lateral movement of split limbs 105 and 107 within limb pocket 122.

Those skilled in the art will now appreciate that an improved limb mounting pocket for a compound archery bow has been described that reliably and securely maintains the butt ends of split limbs within the limb pocket in a manner that prevents lateral shifting of the limbs within the limb pocket. The described limb pocket may be quickly and easily adjusted at the time the compound bow is assembled by a manufacturer to eliminate any lateral spacing between split bow limbs and the limb pocket before shipment to a customer. The improved limb pocket may also be quickly and easily adjusted by the bow owner after the compound bow has been in use to eliminate lateral spacing gaps arising from wear and tear on the bow components. The wedge lock feature of the new limb mounting pocket reduces the need for a manufacturer to maintain such strict manufacturing tolerances on the dimensions of the limb mounting pocket and the split limbs, as has been true in the past in order to prevent lateral shifting of the limbs within the limb mounting pocket. The wedge lock adjustment screw may be easily accessed, either by a bow manufacturer or a bow user, and quickly removes any lateral gaps or spaces between the sides of the bow limbs and the walls of the limb mounting pocket. The use of a tapered wedge, advanced by a screw, generates a relatively significant amount of lateral force that is sufficient to laterally shift the butt ends of the limbs even though the bow limbs are flexed and under tension due to the bowstring and power/synchronization cables that are strung between the cams of the bow. In addition, the disclosed wedge lock system is double-acting in the sense that it simultaneously forces both of the split limbs against the outer walls of the limb mounting pocket through operation of a single adjustment screw. Further, the disclosed wedge lock limb pocket is relatively easy and inexpensive to manufacture.

While the present description has been directed to incorporation of the improved limb mounting pocket within a compound archery bow, those skilled in the art will appreciate that the disclosed limb mounting pocket may also be used to help secure split bow limbs to the riser, or "prod", of a crossbow. In addition, while the first ends of the first and second tabs are fixedly attached to the lower face of the top wall in the preferred embodiment, it will be appreciated that the first ends of the first and second tabs could also be coupled to the top wall by way of a sliding track or other movable coupling arrangements.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A limb mounting pocket for supporting butt ends of split limbs of an archery bow, the archery bow including a riser and further including first and second split limbs, each of the split limbs having a butt end for being coupled to an end of the riser, and each of the split limbs having an opposing limb tip for supporting a cam or pulley, the butt ends of the split limbs each having an inner side wall and an opposing outer side wall, the limb mounting pocket comprising in combination:

a) a top wall for extending above the butt ends of the split limbs, the top wall having first and second opposing sides, the top wall also including an upper face and a lower face, the lower face being directed toward the butt ends of the split limbs;

b) a first outer side wall coupled to the first side of the top wall and extending generally perpendicular to the top wall, the first outer side wall being adapted to engage the outer side wall of the butt end of the first split limb;

c) a second outer side wall coupled to the second side of the top wall and extending generally perpendicular to the top wall, the second outer side wall being generally parallel to, and spaced apart from, the first outer side wall, the second outer side wall being adapted to engage the outer side wall of the butt end of the second split limb;

d) a first tab having a first end coupled to the lower face of the top wall and having an opposing free end, the first tab extending generally perpendicular to the top wall for engaging the inner side wall of the butt end of the first split limb;

e) a second tab having a first end coupled to the lower face of the top wall and having an opposing free end, the second tab extending generally perpendicular to the top wall, the second tab being spaced from the first tab by a gap, the second tab being for engaging the inner side wall of the butt end of the second split limb; and f) an actuating member disposed between the free ends of the first and second tabs for pushing the first and second tabs generally away from each other;

whereby the butt end of the first split limb is secured by the first outer side wall and the first tab against lateral movement, and the butt end of the second split limb is secured by the second outer side wall and the second tab against lateral movement.

2. The limb mounting pocket recited by claim 1 wherein the actuating member is a tapered wedge having first and second opposing tapered surfaces for engaging the first and second tabs, respectively.

3. The limb mounting pocket recited by claim 2 wherein:

a) the tapered wedge has a threaded bore formed therein; and b) an adjustment screw extends from the top wall of the pocket and is threadedly engaged with the threaded bore of the tapered wedge;

whereby tightening the adjustment screw advances the tapered wedge into the gap between the first and second tabs.

4. The limb mounting pocket recited by claim 2 wherein:

a) the first tab has an inner face;

b) the second tab has an inner face;

c) the inner face of the first tab and the inner face of the second tab are directed towards each other; and d) each of the first and second tabs has a thickness that decreases toward the free ends of the first and second tabs.

5. The limb mounting pocket recited by claim 4 wherein the inner faces of the first and second tabs are each tapered.

6. The limb mounting pocket recited by claim 5 wherein the taper formed on the inner faces of the first and second tabs generally corresponds to the taper formed on the first and second opposing tapered surfaces of the tapered wedge to ensure reliable contact between the tapered wedge and the first and second tabs.

7. The limb mounting pocket recited by claim 1 wherein each of the first and second outer side walls includes a hole for receiving a pivot shaft for pivotally supporting the limb mounting pocket to an end of the riser.

8. The limb mounting pocket recited by claim 7 further including a hole formed in the top wall for receiving a limb bolt for adjusting the angular orientation of the limb mounting pocket relative to the riser.

9. The limb mounting pocket recited by claim 1 wherein the first end of the first tab is fixedly attached to the lower face of the top wall, and the first end of the second tab is fixedly attached to the lower face of the top wall.

* * * * *